United States Patent [19]

Jackson

[11] Patent Number: 4,577,546

[45] Date of Patent: Mar. 25, 1986

[54] GUN SIGHT RANGE EXTENDER

[75] Inventor: Theodore A. Jackson, Utica, Mich.

[73] Assignee: Ex-Cell-O Corporation, Troy, Mich.

[21] Appl. No.: 553,457

[22] Filed: Nov. 21, 1983

[51] Int. Cl.[4] ..... F41G 1/40

[52] U.S. Cl. ..... 89/41.19; 33/237; 89/41.01

[58] Field of Search ..... 89/41.19, 41.01; 33/235, 237; 356/7, 256; 350/115, 356

[56] References Cited

U.S. PATENT DOCUMENTS

| | | | |
|---|---|---|---|
| 2,369,806 | 2/1945 | Slonneger | 33/235 |
| 2,390,516 | 12/1945 | Crawford | 89/41.01 |
| 2,466,725 | 4/1949 | Minter | 89/41.01 |
| 3,309,962 | 3/1967 | Lykam | 89/41.01 |
| 3,545,837 | 12/1970 | Chapman | 89/41.19 X |
| 4,193,334 | 3/1980 | Jackson | 89/41.19 |

*Primary Examiner*—David H. Brown

*Attorney, Agent, or Firm*—John C. Evans

[57] ABSTRACT

A gun sight positioning mechanism includes a slip clutch coupled sight slide that enables gun sight optics to be adjusted to extended firing ranges independently of gun inclination; a first range indicator fixed on the gun sight is associated with the sight slide to indicate the "range of target" and coincident adjustment of gun sight optics and a second range indicator is movably fixed to a gun elevating trunnion to serve as a memory of gun inclination so that a gunner will be able to remember to move (if required) the gun following manipulation of the sight slide to a different "range of target" position.

2 Claims, 7 Drawing Figures

GUN SIGHT RANGE EXTENDER

TECHNICAL FIELD

This invention relates to a positioning mechanism for moving a gun sight in a tracking relationship with two associated guns, respectively, having low and high trajectory projectiles and being mounted on a common gun elevating trunnion driven by turret control drive.

BACKGROUND ART

Various proposals have been suggested to operatively associate a gun sight and gun to provide desired tracking relationships therebetween. Equal movement arrangement produced by means of a parallel linkage is set forth in U.S. Pat. No. 2,390,516. U.S. Pat. Nos. 3,309,962 and 3,355,987 disclose gun sight and gun positioning mechanism which either move gun sight optical components or the gun sight itself in accordance with gun and/or gun turret movements.

Usually the field of vision of a gun sight has a reticle with a line or dot pattern or cross-hair that enables a single weapon to be aimed at a target. The gun is aimed by first aligning the vertical line of the reticle with the target and then moving the sight and gun to an inclined position to provide the requisite gun elevation to produce a desired projectile distance to the target. For certain longer target distances the gun sight viewing field is no longer in a line sight relationship with the target. Accordingly, some gun sighting mechanisms incorporate means for allowing the gun sight to be moved independently of the gun to view a projectile impact and then to be returned into an aligned relationship with the gun in targeting purposes. Such an arrangement is shown in my proposal for a slip clutch arrangement covered by U.S. Pat. No. 4,193,334. A further requirement for gun sight positioning may arise if the gun sight is associated with two guns having different projectile distances for a given gun inclination. In such arrangements a single gun sight does not permit simultaneous target sighting for both guns when mounted on the same gun elevating trunnion.

DISCLOSURE OF THE INVENTION

An object of the present invention is to provide an improved gun sight position mechanism that normally moves a gun sight in a tracking relationship with a first weapon having a low trajectory projectile but further includes range extender means to adjust the gun sight range to accommodate the extended target distances of a second weapon having a higher trajectory projectile than that of the first weapon when the first and second are mounted on a common trunnion.

Another object of the present invention is to provide an improved gun sight positioning mechanism as set forth in the preceding object wherein the gun sight includes an optical system drive shaft operated by a sight drive rod connected by crank means to the gun trunnion and range extender means including a sight slide connected to the optical system drive shaft and a first range indicator to adjust the optics of the gun sight to accommodate for the trajectories of the projectiles of the two weapons and by the further provision of a gun trunnion mounted range indicator which stores in memory the firing range of the high trajectory weapon to provide a visual indication of gun elevation and a previous adjustment of the sight slide to assure that weapon elevation coincides with a selected gun sight range whereby the amount of trunnion travel to put either gun on target can be immediately ascertained by observing the range information stored in memory and wherein gun trunnion elevation drive means can be operated to produce movement of the adjusted gun sight and its reticle on target for firing either of the weapons at the selected range.

The positioning mechanism includes a sight drive rod and associated offset crank means that connects the trunnion to a shaft for positioning optical components of the gun sight for angular movement with a gun trunnion shaft which carries a fifty caliber (50 cal.) machine gun and which also carries a 40 mm higher trajectory machine gun.

The gun sight includes a low power viewing window with a unique target selecting reticle pattern for aiming both weapons at targets from zero to a pre-established first maximum range and a higher power sight with adjustable optical components which enable the sight reticle to be placed on target at a desired projectile range.

The trajectory and traverse control of both weapons is provided by gun turret drive means including an elevation control mechanism for driving the gun trunnion and a traverse control mechanism for driving the gun turret on which the trunnion is supported. Connection of gun sight optics is accomplished by a sight drive shaft which is driven by a sight drive rod coupled to the gun trunnion. When the higher trajectory weapon is elevated to fire at extended range targets, a slip slide arm is moved with respect to a gun sight mounted indicator ramp to select an extended target range marked by range indicia on the indicator. The slip slide mechanism drives an optical component in the gun sight to cause it to be on target when an elevation range line on the reticle is placed on the target.

The trunnion carries a second range indicator that maintains a continuous memory read-out of the range of the higher trajectory weapon so that the gunner will have an indication of the elevation of the weapons with the higher trajectory projectile. Thus, if the slip slide is positioned to aim the higher trajectory weapon at targets beyond a first range, the gunner can refer to the selected range on a second indicator (range memory drum) to indicate the amount of elevation drive required to return the trunnion and connected weapons to a firing position which corresponds to a second range set in the sight by use of the slip slide mechanism. Thus, trial and error movement of the weapons can be reduced when the weapon elevation and range adjusted gun sight reticle are moved to place the gun sight on target.

The objects, features and advantages of the present invention are readily apparent from the following description of the best mode for carrying out the invention when taken in connection with the accompanying drawings.

BEST MODE FOR CARRYING OUT THE INVENTION

Figure 1:
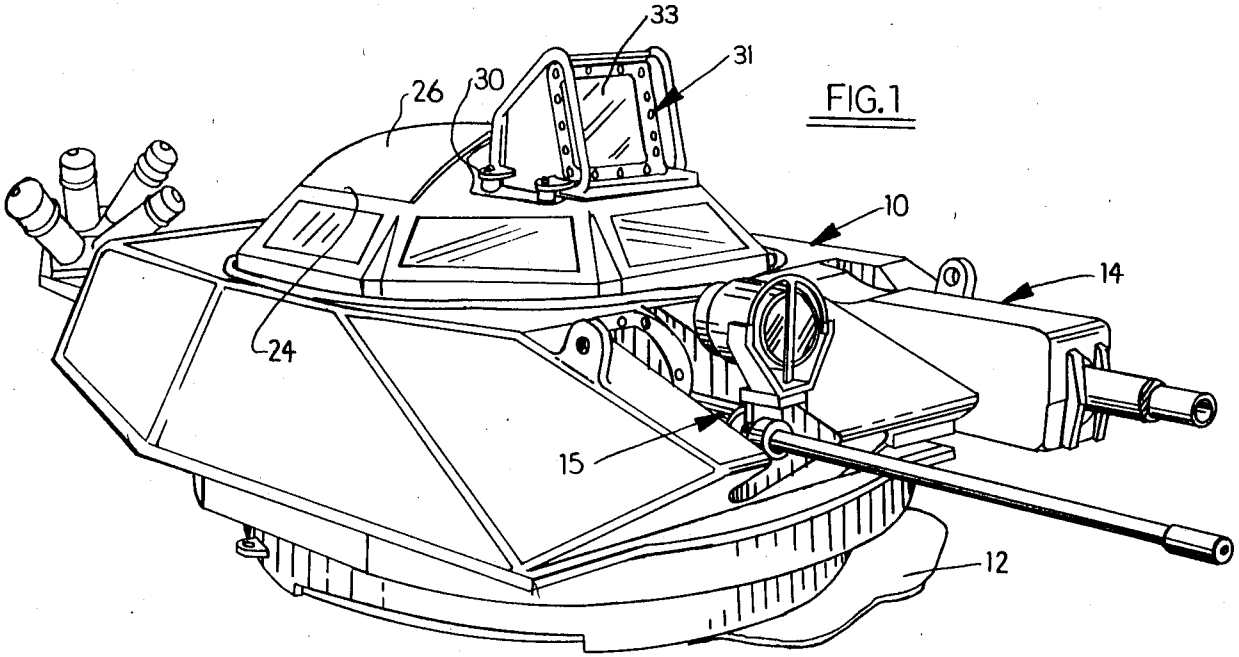
FIG. 1 is a perspective view of a turret having the two-weapon firing system and associated gun sight system of the present invention.
Figure 2:
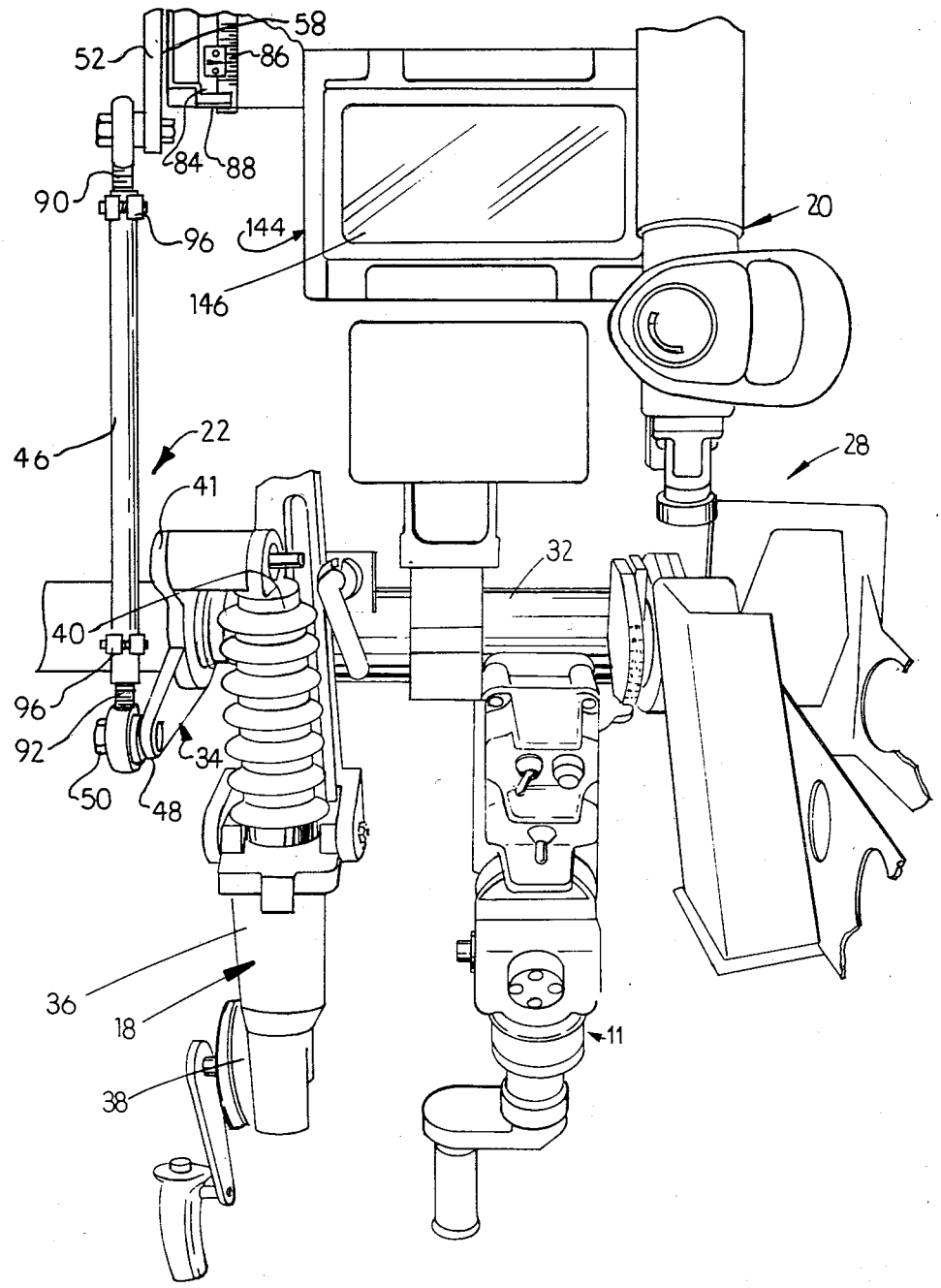
FIG. 2 is a perspective view of an interior of a turret incorporating the two-weapon gun sight system of the present invention.

Referring to FIGS. 1 and 2 of the drawings, a gun turret indicated by 10 is rotatably supported and driven by a traverse control 11 about a vertical axis on an armored vehicle 12 and includes two automatic guns 14, 15. Upward and downward angular movement of the guns 14, 15 to change the inclination of the projectile path is controlled by an angular positioner or elevation control indicated by 18. A gun sight 20 is coupled with the gun 14 by a positioning mechanism 22 (shown in FIG. 7) which is constructed in accordance with the present invention. Gun turret 10 has an upper hatch 24 that is selectively closed by a cover 26 so that a gunner within the turret compartment 28 is protected while operating the guns. Gun sight 20 is secured to the turret 10 by nut and bolt connections 30 with its upper end projecting above the turret within a view block 31 having a view window 33 its lower end received within the compartment 28 and connected with the positioning mechanism 22 in a manner that is more fully hereinafter described.

Figure 7:
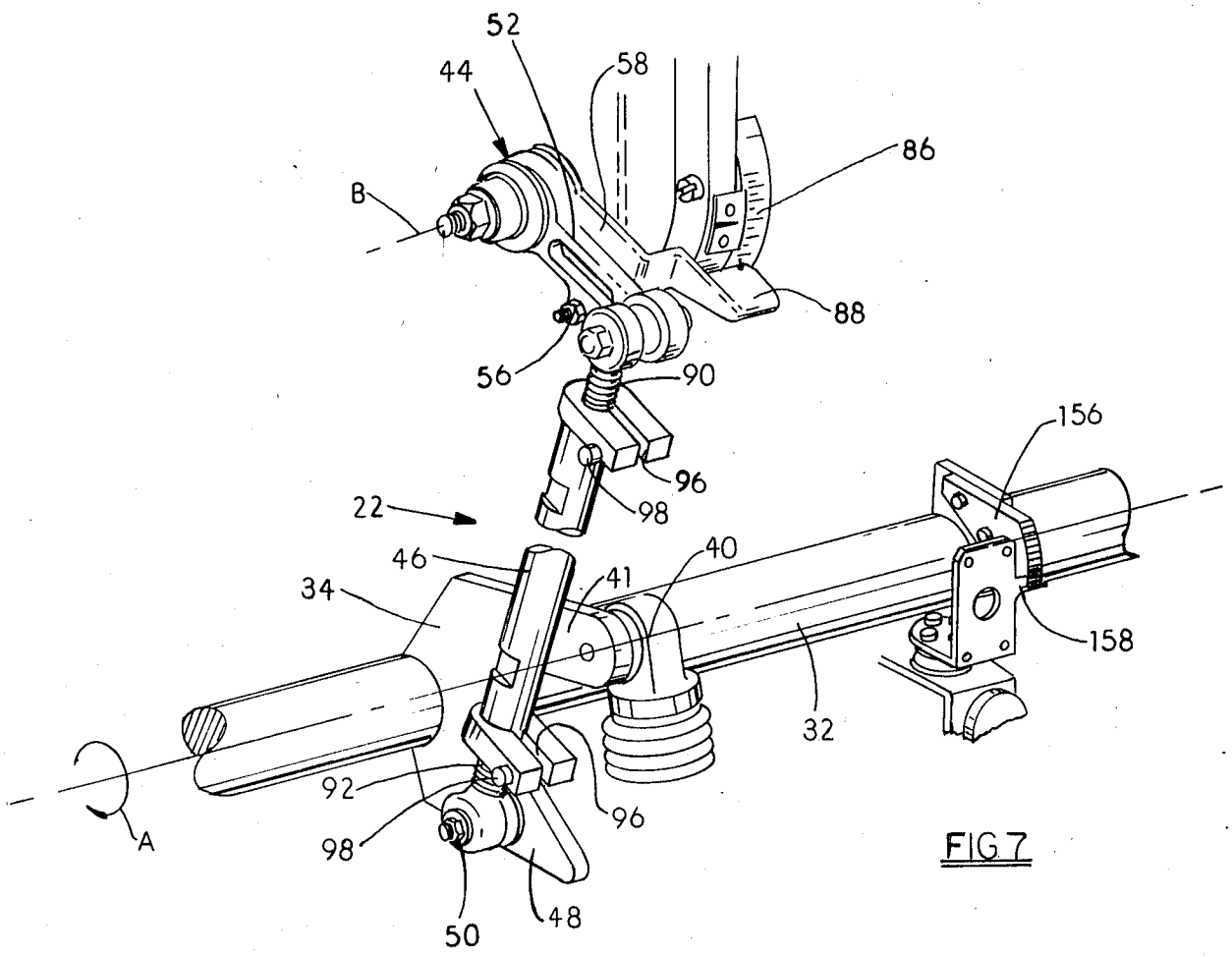
FIG. 7 is a perspective view of gun sight drive components and associated range indicators.

As seen in FIGS. 2 and 7, guns 14, 15 are supported on the turret 10 for angular movement along the central axis A of a trunnion shaft 32 in order to control the angular inclination of projectiles fired by the guns. Crank 34 has an inner end which is fixedly secured to the trunnion shaft 32 such that pivoting of the link 34 about axis A pivots the gun 14 thereabout through the connection provided by the trunnion shaft. Gun positioner 18 includes a control cylinder 36 that is pivotally supported by a bearing 38 and includes a piston connection rod whose distal end 40 is secured to the outer end 41 of crank 34 by a pivotal connection. Control fluid selectively supplied to the cylinder 36 on opposite sides of a piston therein extends and retracts the rod so as to thereby pivot the crank 34 about axis A and control the vertical inclination of the guns 14, 15. Extension of rod 40 pivots the crank 34 and the trunnion shaft 32 counterclockwise so as to pivot the gun 14 downwardly, while rod retraction pivots the link and the trunnion shaft clockwise and thereby pivots the gun upwardly.

Figure 3:
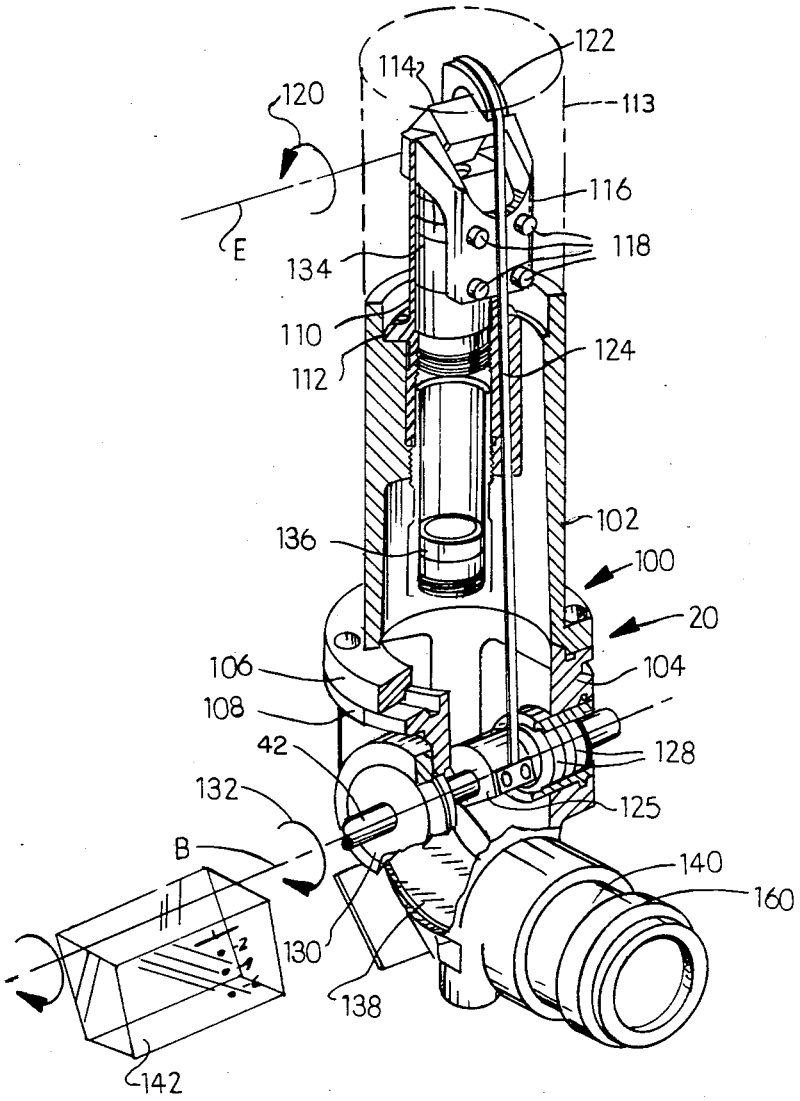
FIG. 3 is a perspective view, partially broken away and sectioned of one type of a two-field gun sight utilized in the present invention.
Figure 4:
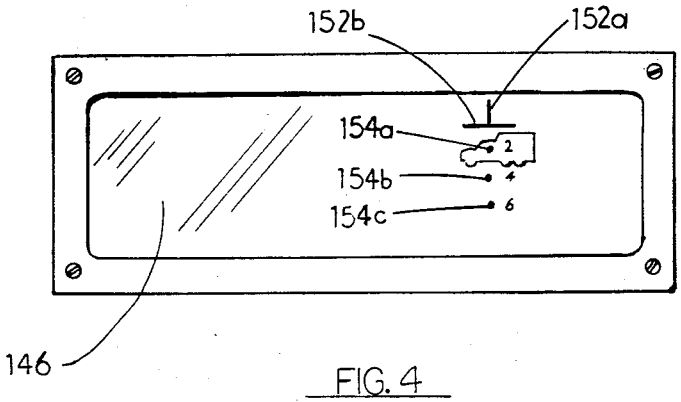
FIG. 4 is a front elevation view of a one-power projected sight reticle.

With additional reference to FIGS. 3 and 4, the gun sight 20 includes a positioning shaft 42 (FIG. 6) that is pivotable about an axis B parallel to axis A in order to control the vertical inclination at which the gun sight is aimed. Positioning mechanism 22 includes a parallelogram linkage that extends between the gun trunnion shaft 32 at axis A and the gun sight positioning shaft 42 at axis B in order to move the positioning shaft of the gun sight angularly with the gun in a tracking relationship. Upward or downward pivoting of the guns along axis A for any angle of adjustment is thus accompanied by a concomitant angular rotation of the shaft 42 in order to maintain the gun sight aimed along the direction of the gun barrel. A slip clutch 44 (FIG. 6) of the mechanism connects the parallelogram linkage to an shaft 42 to normally provide the angular pivoting thereof with the gun as previously described. For relatively long target distances, slipping action of clutch 44 allows the gun sight to be aimed downwardly at the target area to view the impact while the gun remains upwardly along the projectile path.

With reference to FIG. 7, the parallelogram linkage of positioning mechanism 22 includes a sight drive rod 46 whose inner end has a connection to the trunnion shaft 32 at an end 48 of crank 34 to which the rod is fixedly secured by bolt 50 to project outwardly in a radial direction with respect to the axis A. A sight drive arm 52 of the linkage has a connection to the gun sight positioning shaft 42 along axis B provided by the slip clutch 44. Arm 52 projects radially from the axis B in a parallel relationship to the crank 34 that projects radially from axis A. Crank end 48 and the end of arm 52 are connected with each other by a sight drive rod 46 of the parallelogram linkage. Rod 46 extends parallel to a line through axes A and B and has a length between pivotal connections at opposite ends thereof which is equal to the spacing between the axes A and B. As such, angular rotation of the trunnion shaft 32 pivots the crank 34 so that the rod 46 is shifted to pivot drive arm 52 through the same angle as the gun and thereby move the gun sight positioning shaft 42 about axis B so that the gun sight tracks with the guns.

Figure 6:
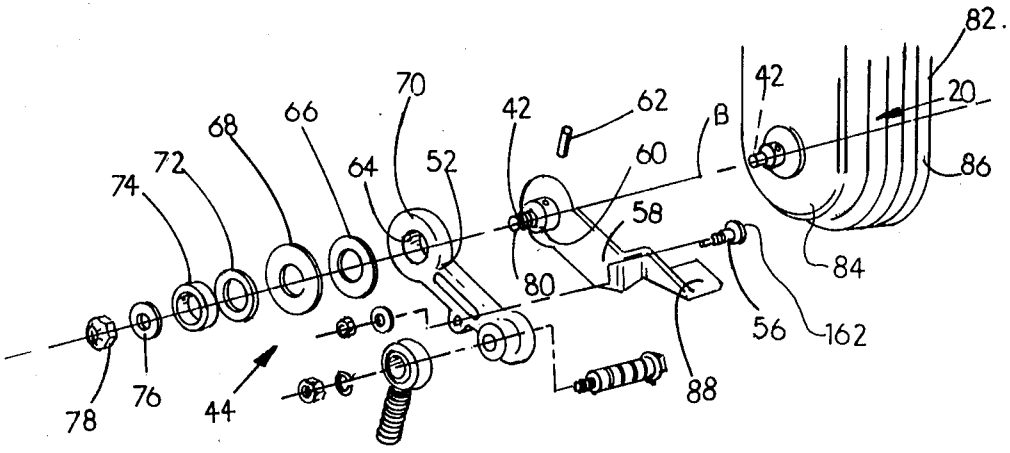
FIG. 6 is an exploded view of the input clutch and drive mechanism for a sight drive shaft of FIG. 3.

Sight drive arm 52 is connected to the gun sight positioning shaft 42 by the slip clutch 44 shown best in FIG. 6. An eccentric screw stop 56 on the end of arm 52 is provided. It is engaged by a sight slide arm 58 in order to facilitate realignment of the gun sight with the gun. For relatively long target distances where the gun sight field of vision does not encompass the target when aligned with the guns, slide arm 58 is pivoted counterclockwise about the axis B to aim the gun sight 20 downwardly independently of any gun movement and thereupon moves out of the engaged condition with the stop 56 as shown in FIG. 7. Impact of the fired projectile can thus be viewed through the gun sight even for long target distances. Subsequently, the arm 58 is pivoted clockwise back into engagement with the stop 56 so that the parallelogram linkage of the positioning mechanism 22 again aligns the gun sight with the gun. During both the clockwise and counterclockwise pivoting of the slide arm 58, the slip clutch 44 allows independent movement of the gun sight positioning shaft 42 without any movement of the parallelogram linkage or the trunnion shaft 32 to which both the linkage and the gun are connected.

Slip clutch 44 includes a tube-like adapter 60 that receives the gun sight positioning shaft 42 and is rotatably fixed thereto by a pin 62. The arm 58 is rotatably fixed to adapter 60. The inner end of drive arm 52 has a round opening 64 that receives the adapter 60.

A brake disc 66 and brake pad 68 are also carried by adapter 60 and are held in frictional engagement with the face 70 of drive arm 52 by a spring washer 72 that is held in place on adapter 60 by an adapter retainer ring 74 and by means of a washer 76 and a hex nut 78 on the threaded end 80 of shaft 42.

A first range indicator member 82 is fixedly secured to the lower end 84 of gun sight 20. Its front face 86 is arcuately shaped and carries gun firing distance indicia which are located adjacent an indicator tab 88 on the sight slide arm 58. Clockwise pivoting of arm 58 puts tab 88 adjacent higher markings on the face 86 corresponding to higher inclinations of the guns supported by the trunnion shaft 32.

Drive rod 46 can be adjusted by the threading of the rod ends 90 and 92 in order to adjust the length of the rod to provide the proper tracking relationship. Each end of the rod has axial slots and an associated clamp 96 that secures the associated rod end after the length adjustment. Threaded screws 98 of the clamps 96 are loosened to allow the adjustment of the rod ends in a turn-buckle fashion as the link member 46 is rotated and the screws are subsequently tightened to clamp the rod ends at the slots 94 of the link member in order to fix the link length after the adjustment. Since the tightening of the clamps 96 is not in an axial direction as is the case with jam nuts, the adjusted length of the link remains the same before and after the clamping action by clamps 96.

FIG. 3 illustrates the construction of the periscope gun sight 20 which is one type of gun sight with which the positioning mechanism of the present invention is adapted to be utilized. Sight 20 includes a housing 100 having an upper member 102 that is adapted to project upwardly through a gun turret and a lower member 104 that is received within the turret gunner compartment. Flanges 106 and 108 of the housing members 102 and 104, respectively, are secured to each other by the nut and bolt connections to maintain the housing members in the engaged position shown. An upper housing extension 110 has a flange 112 that is secured to the upper housing member 102 by suitable threaded fasteners (not shown) and is normally enclosed within a cover 113 illustrated by phantom line representation. A glass covered opening of the cover which is not shown is aligned with a prism 114 that is mounted by a support 116 secured to the housing extension 110 by threaded fasteners 118.

Prism 114 of the gun sight shown in FIG. 3 is aligned on the gun turret with the direction of gun barrel orientation and is pivotally mounted on the support 116 about a horizontal axis E which is located in a parallel relationship with the axis of the gun trunnion shaft. A suitable biasing spring (not shown) biases the prism 114 in the direction shown by arrow 120 which corresponds to a downwardly direction of prism inclination with respect to the horizontal. A strap connector member 122 is bonded or otherwise suitable secured to the prism 114 for pivotal movement therewith and secures the upper end of a generally flexible strap 124 whose engagement with the connector member is at a partially circular surface generated about the axis E. The lower end of strap 124 is secured to a connector member 125 fixed on a sight positioning shaft 126 and is engaged with a partially circular surface of this connector member generated about the axis B of shaft movement. Bearings 128 support the shaft 126 for movement about axis B and a clock-like biasing spring within a housing 130 biases the shaft in the direction shown by arrow 132 so that the strap 124 is tensioned in cooperation with the bias provided on the prism 114.

An image received by the prism 114 through the opening in cover 113 is projected downwardly through magnifying units 134 and 136 supported by the housing extension 112 and is reflected by a mirror 138 to an eyepiece 140 that has suitable reticle markings. Pivotal movement of the shaft 42 by the positioning mechanism in the manner previously described pivotally positions the prism 114 so that the image received and transferred to the eyepiece 140 corresponds to an aligned relationship with the gun barrel. The partially circular surfaces of the connector members 122 and 126 over which the ends of the strap 124 are engaged insure that the shaft movement is accompanied by corresponding movement of the prism.

Suitable linkage can transfer sight shaft movement to the prism 142 of a one-power sight 144 which has a viewing field 146 located to one side and above the eyepiece 140.

Figure 5:
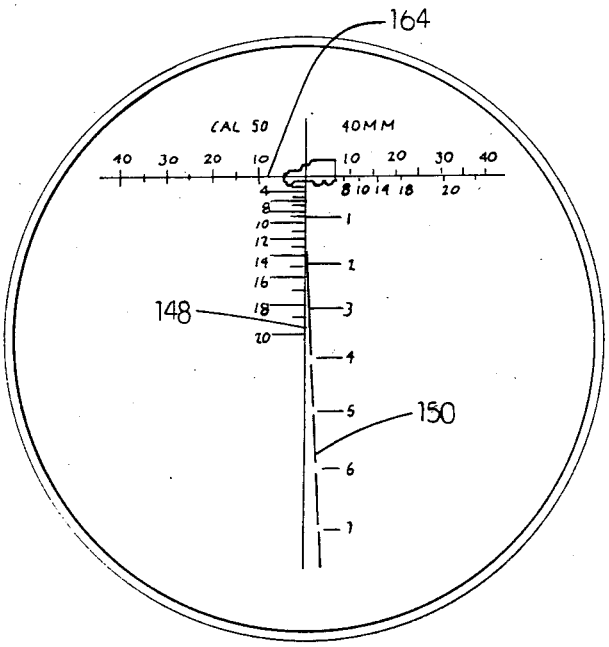
FIG. 5 is a front elevation view of an eight-power projected sight reticle.

The eight-power reticle is shown in FIG. 5 as including elevation firing range lines 148, 150, respectively, for a 50-caliber gun and a 40 mm machine gun. The one-power reticle is shown in FIG. 4 as including 50-caliber cross hairs 152*a,b* and three range markers 154*a,b,c* for the 40 mm machine gun.

Additionally, the gun sight system of the present invention includes a pie-sector shaped range indicator 156 secured to the trunnion shaft 32 for rotation therewith. It is moved with respect to a range pointer 158 to indicate the gun inclination (and firing range of the 40 mm weapon).

A typical sighting includes the following representative sequences.

In order to sight the 50-caliber barrel the gunner sights the target through the one-power viewing field 146 and moves the turret 10 through azimuth and elevation (by rotating trunnion shaft 32) to bring the cross hairs 152 onto the target. If either the vehicle or target is moving and is within a 600-meter range, the one-power viewing field 146 can be used to aim guns and fire at the target. The cross hair 152 has a vertical line 152*a* for centering both guns on target. A horizontal line 152*b* of the cross hairs 152 is an O-meter line for the 40 mm gun and the dots represent 40 mm ranges of 200 m; 400 m; and 600 m, respectively.

If the 50-caliber weapon target is beyond 600 m the target is sighted using the eight-power eyepiece and adjusting its diopter adjustment ring 160 to bring the eight-power reticle of FIG. 5 into sharp focus on target. Corrections in both azimuth and elevation are then made by the turret elevation and traverse control to put the cross hairs of the reticle on target for firing of the weapon.

The sight sequence for firing the 40 mm weapon is likewise first accomplished by use of the one-power viewing field to targets with a 600 meter range. The vertical line 152*a* is used to center the target. Dots 154*a, b, c* are used to place the 40 mm gun on target at ranges 200 m; 400 m and 600 m.

When the 40 mm machine gun is fired at targets from 0 to 700 meters the sight slide arm 58 is moved into contact with the eccentric screw stop 56. Stop 56 has an eccentric surface 162 which can be rotated to adjust the sight optics to a reference position to calibrate the guns during bore sighting. The reticle drift line 150 on the eight-power reticle is used to center sight the target up to 700 meters.

At firing distances more than 700 meters, the slip slight slide arm 58 is positioned so that its indicator tab 88 is located adjacent the increased range marker on the range indicator 82. The elevation control is then used to rotate trunnion shaft 32 to bring the target into the eyepiece. When the target is on horizontal line 164 the target is centered to lower numerals on horizontal line 164 with a range corresponding to that selected on indicator 82.

Then the range indicator 156 is checked to see if the trunnion shaft rotation (gun inclination) range corresponds to the optic setting slip slide selected range. If there is correspondence, the gun is in position to be fired. A test shot can be fired and the projectile hit observed to check range in elevation and azimuth; slight reset can be made to turret controls 11, 18 and then the weapon gunner can fire for effect.

In accordance with the invention, if the gunner picks up a new target and adjusts the gun sight optics to a new range by repositioning the slip slide to the new target range, a back-up memory is provided by drum indicator 156 to assure alignment of the gun inclination with the desired selected firing range. The prior firing range (gun inclination) is maintained during readjustment of the gun sight slip slide arm 58 and the gunner can check the trunnion shaft indicator to determine to what extent (if any) it must be repositioned to properly aim the 40 mm gun.

The embodiments of the invention in which an exclusive property or privilege is claimed are defined as follows.

What is claimed is:

1. A gun sight system for a pair of guns mounted on a turret operator-controlled trunnion shaft comprising: gun sight means having means including an input shaft to adjust optics to select a target range; sight linkage means including a sight drive arm for coupling said input shaft for concurrent rotation with the trunnion shaft; first range indicator means fixed to said gun sight means and including range indicia thereon; a sight slide arm directly coupled to said input shaft for rotating it independently of said sight linkage means and including means positioned with respect to said first range indicator means to indicate range adjustment of said optics; and second range indicator means fixedly secured to said trunnion shaft and movable therewith to indicate the amount of gun inclination independently of said first range indicator means.

2. In the combination of claim 1, said sight linkage means including a crank arm connected to said trunnion shaft having spaced free ends; an elevation drive cylinder connected to one free end, an adjustable length sight drive rod means connected between the other free end and said sight drive arm; an eccentric screw secured to said sight drive arm to serve as an adjustable reference surface for positioning said sight slide in a first position for adjusting the gun sight optics for on-target firing of one of the guns; said sight slide being movable from said stop position to reposition the gun sight optics.

* * * * *